US006695696B1

(12) United States Patent
Kaminkow

(10) Patent No.: US 6,695,696 B1
(45) Date of Patent: Feb. 24, 2004

(54) GAMING DEVICE HAVING A REPLICATING DISPLAY THAT PROVIDES WINNING PAYLINE INFORMATION

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 65 days.

(21) Appl. No.: 09/629,606

(22) Filed: Jul. 31, 2000

(51) Int. Cl.[7] ..... A63F 9/22
(52) U.S. Cl. ..... 463/16; 273/138.2
(58) Field of Search ..... 463/1, 16–20, 463/25, 30, 31, 40, 42, 43; 273/138.1, 143 R

(56) References Cited

U.S. PATENT DOCUMENTS

| | | | | |
|---|---|---|---|---|
| 4,621,814 A | | 11/1986 | Stepan et al. | |
| 4,695,053 A | | 9/1987 | Vazquez, Jr. et al. | |
| 4,805,907 A | * | 2/1989 | Hagiwara | 273/138 A |
| 4,838,552 A | * | 6/1989 | Hagiwara | 273/138.1 |
| 5,342,047 A | | 8/1994 | Heidel et al. | |
| 5,580,055 A | * | 12/1996 | Hagiwara | 273/143 R |
| D392,340 S | | 3/1998 | DeSimone | |
| 5,766,074 A | | 6/1998 | Cannon et al. | |
| 5,772,509 A | | 6/1998 | Weiss | |
| 5,807,172 A | | 9/1998 | Piechowiak | |
| 5,882,105 A | | 3/1999 | Barlow | |
| 5,902,184 A | | 5/1999 | Bennett | |
| 5,911,418 A | | 6/1999 | Adams | |
| 5,934,672 A | * | 8/1999 | Sines et al. | 273/143 R |
| 5,951,397 A | | 9/1999 | Dickinson | |
| D416,054 S | | 11/1999 | McGahn et al. | |
| 5,980,384 A | | 11/1999 | Barrie | |
| 5,984,781 A | | 11/1999 | Sunaga | |
| 5,997,401 A | | 12/1999 | Crawford | |
| 6,056,642 A | | 5/2000 | Bennett | |
| 6,071,192 A | | 6/2000 | Weiss | |
| 6,089,977 A | | 7/2000 | Bennett | |
| 6,089,978 A | | 7/2000 | Adams | |
| 6,093,102 A | | 7/2000 | Bennett | |
| 6,120,378 A | * | 9/2000 | Moody et al. | 463/20 |
| 6,126,165 A | | 10/2000 | Sakamoto | |
| 6,135,884 A | | 10/2000 | Hedrick et al. | |
| 6,142,874 A | | 11/2000 | Kodachi et al. | |
| 6,159,095 A | | 12/2000 | Frohm et al. | |
| 6,358,147 B1 | * | 3/2002 | Jaffe et al. | 463/20 |

OTHER PUBLICATIONS

Red Hot Roll Brochure (and Description) published by Barcrest Ltd.
Jackpot Party Brochures and Articles published by WMS Gaming, Inc. in 1998.
Totem Pole Brochure published by IGT in 1997.
Dynamic Paytable Description published by IGT Australia.

* cited by examiner

*Primary Examiner*—Mark Sager
*Assistant Examiner*—Steven L Ashburn
(74) *Attorney, Agent, or Firm*—Bell, Boyd & Lloyd LLC

(57) ABSTRACT

The present invention involves a gaming device that provides a second or replicating display that is an enlarged, preferably simulated replica of the actual display of the reels, paylines and indicia of the paystops of the gaming device. The second or replicating display can exactly recreate the actual rotation or random generation of the reels, represent the random generation of the reels, and do so by providing a slight delay. The present invention also contains a method by which the replicating display presents each of a plurality of award generating or winning paylines individually and sequentially for a predetermined amount of time before culminating in a display of the accumulated winning paylines. The method enables the player to easily see the source of an award, which would otherwise be difficult to discern from a multitude of paylines.

62 Claims, 11 Drawing Sheets

GAMING DEVICE HAVING A REPLICATING DISPLAY THAT PROVIDES WINNING PAYLINE INFORMATION

CROSS-REFERENCE TO RELATED APPLICATIONS

This application is related to the following commonly-owned co-pending patent applications: "GAMING DEVICE WITH TRAVELING REEL SYMBOLS," Ser. No. 09/606,928, "GAMING DEVICE AND METHOD FOR ENHANCING THE ISSUANCE OR TRANSFER OF AN AWARD," Ser. No. 09/583,482, "GAMING DEVICE WITH MULTI-PURPOSE REELS," Ser. No. 09/606,733, "GAMING DEVICE WITH MOVING SCREEN SIMULATION," Ser. No. 09/625,884, "GAMING DEVICE WITH SIGNIFIED REEL SYMBOLS," Ser. No. 09/605,344, "GAMING DEVICE HAVING COMPETITION BONUS SCHEME," Ser. No. 09/628,144, "GAMING DEVICE HAVING TOUCH ACTIVATED ALTERNATING OR CHANGING SYMBOL," Ser. No. 09/602,331, "GAMING DEVICE PROVIDING TOUCH ACTIVATED SYMBOL INFORMATION," Ser. No. 09/680,349, "GAMING DEVICE HAVING A MULTIPLE SCREEN BONUS ROUND," Ser. No. 09/629,235, "GAMING DEVICE PROVIDING AUDIO WAGERING INFORMATION," Ser. No. 09/629,288, "GAMING DEVICE HAVING MULTIPLE AUDIO, VIDEO OR AUDIO-VIDEO EXHIBITIONS ASSOCIATED WITH RELATED SYMBOLS," Ser. No. 09/689,529, "GAMING DEVICE HAVING INTERACTING SYMBOLS," Ser. No. 09/686,308, and "GAMING DEVICE HAVING A SYMBOL COVERING FEATURE," Ser. No. 09/684,275.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device with a video display that mirrors the random generation display mechanism of the gaming device and clarifies multi-payline machines having complex payout schemes.

BACKGROUND OF THE INVENTION

Gaming device manufactures have long provided gaming machines employing a plurality of reels, wherein the reels each have a plurality of symbols. In these games, the player "spins" a number of reels that act independently to produce a random generation of a combination of symbols. If the generated combination, or a portion of the combination, matches one of a number of predetermined award producing or winning combinations, the player receives an award.

To increase player enjoyment and excitement, and to increase the popularity of the gaming machines, gaming device manufacturers constantly strive to provide players with new types of gaming machines that attract the player and keep the player entertained. One proven way manufacturers use to make their machines more popular is to increase the number and variety of winning combinations and provide more opportunities for the player to win. Providing more variety and opportunities holds the player's interest for a longer time and also enables the manufacturer to have a larger range of payouts for the winning combinations. The larger range increases the size of the largest possible payout of the gaming device, and large payouts tend to attract players.

To increase variety and opportunity, manufacturers have increased the number of possible symbol positions or paystops. Increasing paystops increases the number of different symbols a game can have and increases the number of times a particular symbol can appear. Increasing the number of times that a symbol can appear increases its likelihood of appearance, which affects the payout of a winning combination containing that symbol. Winning combinations that have a rare or low likelihood of appearance tend to have higher payouts.

One way manufactures have increased the number of paystops has been to increase the size of the reel to accommodate more stops. Original gaming machines had approximately ten stops per reel, modern mechanical reels have approximately thirty to thirty five stops per reel and modern video machines have no physical limit to the number of stops per reel. Another way manufacturers have increased the number of paystops has been to add reels. Original gaming machines had three reels, while modern mechanical machines have employed up to five reels. Video reel machines have not increased the number of reels above five mainly because five reels create enough diversity to keep the game interesting without becoming too complex for the player to enjoy.

Another avenue that manufacturers have taken to provide more variety, opportunity, enjoyment and excitement has been to increase the number of paylines. Paylines are the sequence or line of paystops that the machine analyzes to determine if the player has won an award. The paylines in essence define the combination or group of paystops to be analyzed. Original gaming machines had only one payline. Modern machines sometimes called "line" machines have multiple paylines that contain a number of rows, lines or sequences of paystops that form combinations for the gaming device to analyze. The multiple rows, lines or sequences present multiple opportunities for the player to obtain a winning combination of symbols. Usually, players have to wager more to obtain the benefit of the multiple lines. Many games provide a bonus jackpot for playing the maximum number of coins and paylines, which means the player increases the payout values by playing all the paylines.

The line machines display multiple rows of paystops generated by each reel of the gaming device, wherein each row is a payline. Machines having at least three reels and displaying at least three rows of symbols create diagonal lines, wherein each diagonal line is also a payline. Machines having five reels and displaying at least three rows have many possible paylines, wherein the only criterion is that each paystop of a line or sequence must be adjacent to at least one other paystop of the line. Consequently, certain known gaming machines have up to nine different paylines, wherein a player can make up to nine different bets each time the player spins the reels.

It should be appreciated that gaming machines have become rather complex in comparison to the original three reel, ten stop machine created before 1900. At some point, adding variety yields diminished returns as the inevitable accompanying complexity of placing multiple bets and trying to keep tract of multiple winning combinations for each bet becomes too complex for the player. A player may win after a given spin of the reels and find it difficult to determine how, where or why the player has won. Mechanical reels, which are limited in drum radius, have limited space with which to display the multitude of symbols. Simulated reel displays are also limited in size to make room for other input devices and displays requiring panel space. The limited display space and viewing area furthers the complexity created by the multitude of paylines and winning combinations.

Therefore, a need exists to create a second, preferably larger display that follows or mirrors the display of the operation of the actual reels, which randomly generate different combinations of symbols. A need also exists to have such a second display parse or separate the paylines on which the player has won from the remainder of the paylines and symbols of said display. Such a display is preferably simulated so that it can show other necessary indicia and different successful paylines at different times.

SUMMARY OF THE INVENTION

The present invention involves a gaming device that provides a second or replicating display that is an enlarged, preferably simulated replica of the actual display of the reels, paylines and indicia of the paystops of the gaming device. The second or replicating display can exactly recreate the actual rotation or random generation of the reels or do so by providing a slight delay. The present invention also contains a method by which the replicating display presents each of a plurality of award generating or winning paylines individually and sequentially for a predetermined amount of time before culminating in a display of the accumulated winning paylines. The method enables the player to easily see the source of an award from a multitude of paylines, which would otherwise be difficult to discern.

In the replicating embodiment, the replicating display contains the same number of reels, the same number of paylines, the same number of paystops and the same indicia and order of indicia on the paystops as does the actual display or paystop display. The replicating display is preferably larger than the paystop display so that a player can easily see the action of the gaming device after setting the reels in motion, and so that the player can more easily discern the source of the player's award or success. The replicating display preferably exactly replicates, follows or shadows the rotation of the actual reels including the oscillation or overshoot created by the weight of mechanical reels coming to an abrupt stop.

In an alternative embodiment, the replicating display follows or is slightly behind the paystop display. The slight delay contemplated by the present invention provides an enjoyable and aesthetic effect for the player. The delay can be for any suitable time period but preferably is less than a second.

The replicating display can also contain indicia relating to a theme of the gaming device. Such indicia are preferably displayed in addition to the replicating of the paystop, however, the present invention can display the indicia in place of or instead of the replicating. At certain times, such as when no one is playing the gaming device, the mirroring device preferably displays the indicia video clips, or other entertainment relating to the theme of the device (as opposed to mirroring the idle symbols). Alternatively, the replicating display can display static and dynamic sequences, where in the indicia of said sequences have no relation to the theme of the gaming device. When nobody is playing the gaming device, the implementor may wish to display animations unrelated to the theme of the gaming device.

When the replicating device finishes displaying the random generation of the reels of the paystop display, the present invention preferably provides a method or sequence of displaying the player's awards in a serial fashion, such that the player can easily discern the source of the award. In a device wherein the player plays many paylines, e.g., nine at once, the present invention contemplates displaying each payline that generates an award individually and sequentially. At the end of the individual displays, the present invention displays an accumulation of all the award generating paylines in the replicating display.

The method of presenting award generating paylines enables the player to easily see the source of an award. The present invention preferably stops one payline display before beginning another, although the displays can overlap. Alternatively still, the replicating display can accumulate the award generating paylines one after another until they are all displayed at once. The payline displays preferably last from one to two seconds each, and each payline display can last for a different period of time. The present invention does not require that the paylines be presented in any order, however, the present invention preferably displays the paylines in the order that the gaming device presents the paylines to the player.

In addition, the present invention contemplates providing a backlighting system that highlights certain symbols of the reels at certain times. Lights disposed behind the reels are connected to the controller of the gaming device. The controller can selectively light one or more of the lights at various times. The present invention contemplates lighting the reels during the replicating portion of the game and dimming the reels during the winning payline display.

It is therefore an object of the present invention to provide a gaming device with a second, larger display that follows or mirrors the display of the operation of the actual reels so that the player may easily see the generation and outcome of a combination of reels.

Another object of the present invention is to provide a gaming device that can parse or separate the paylines on which the player has received an award from the remainder of the paylines and symbols of the reels and display the winning paylines to the player individually and in total.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
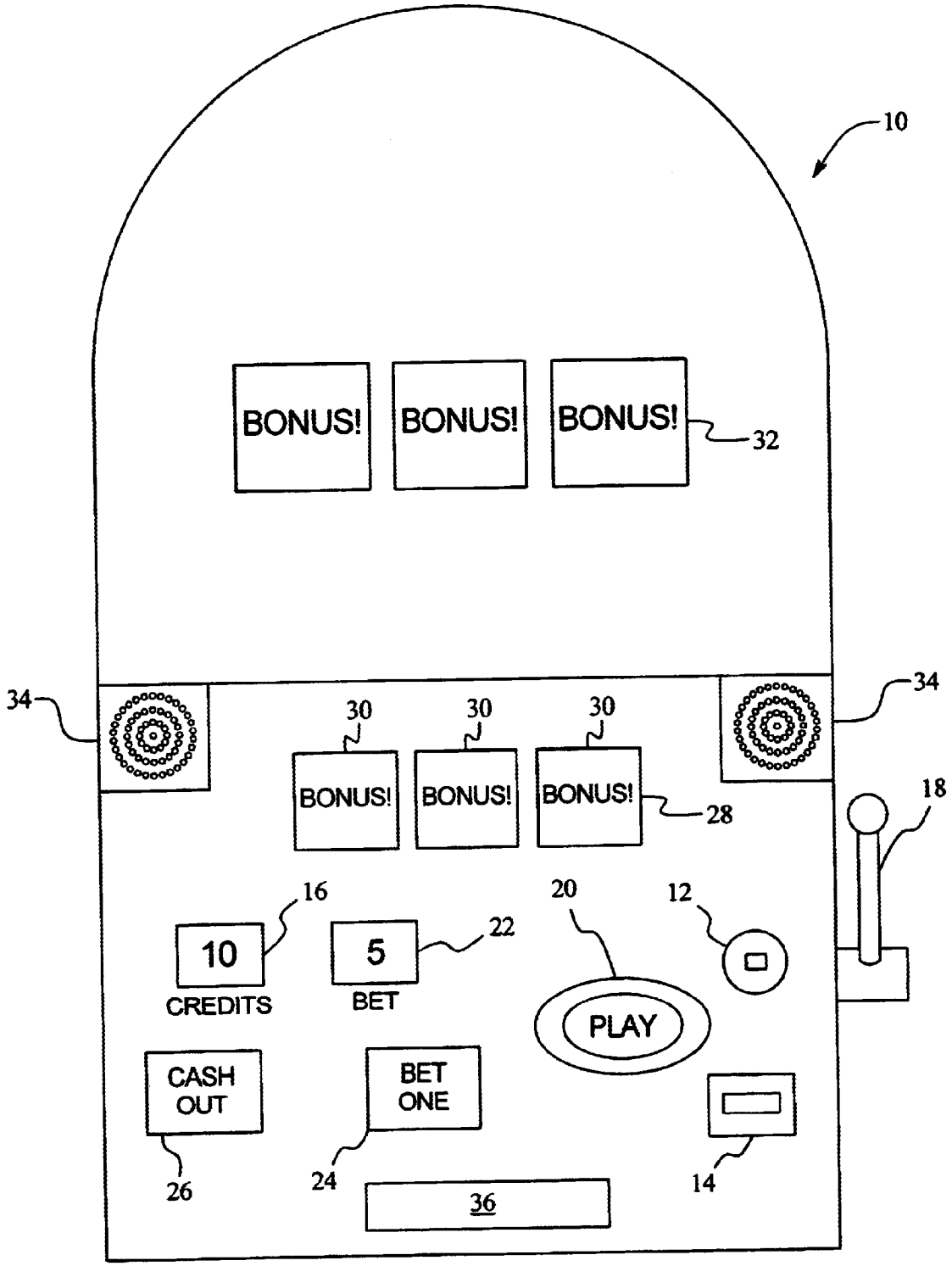
FIG. 1 is a front plan view of a general embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) that a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform. Gaming device 10 can incorporate any game such as slot, poker or keno. The symbols used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20. Play button 20 can be any play activator used by the player which starts any game or sequence of events in the gaming device.

Referring to FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a paystop display 28 which contains a plurality of reels 30, preferably three to five reels in mechanical or video form. Each reel 30 displays a plurality of symbols such as bells, hearts, martinis, fruits, cactuses, numbers, cigars, letters, bars or other images which preferably correspond to a theme associated with the gaming device 10. If the reels 30 are in video form, the gaming device 10 preferably displays the video reels 30 in a video monitor described below. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

With respect to electronics, the controller of gaming device 10 preferably includes the electronic configuration generally illustrated in FIG. 2, which has: a processor 38; a memory device 40 for storing program code or other data; a video monitor 32 (i.e., a liquid crystal display) described in detail below; a plurality of speakers 34; and at least one input device as indicated by block 33. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

The processor 38 is preferably a microprocessor or microcontroller-based platform which is capable of displaying images, symbols and other indicia such as images of people, characters, places, things and faces of cards. Although not shown, gaming device 10 can provide a second, slave processor, with which the processor 38 can communicate through a suitable protocol. The gaming device 10 can employ the processor 38 to tell or command the slave processor to perform certain functions, such as to display certain images on the display.

Figure 2:
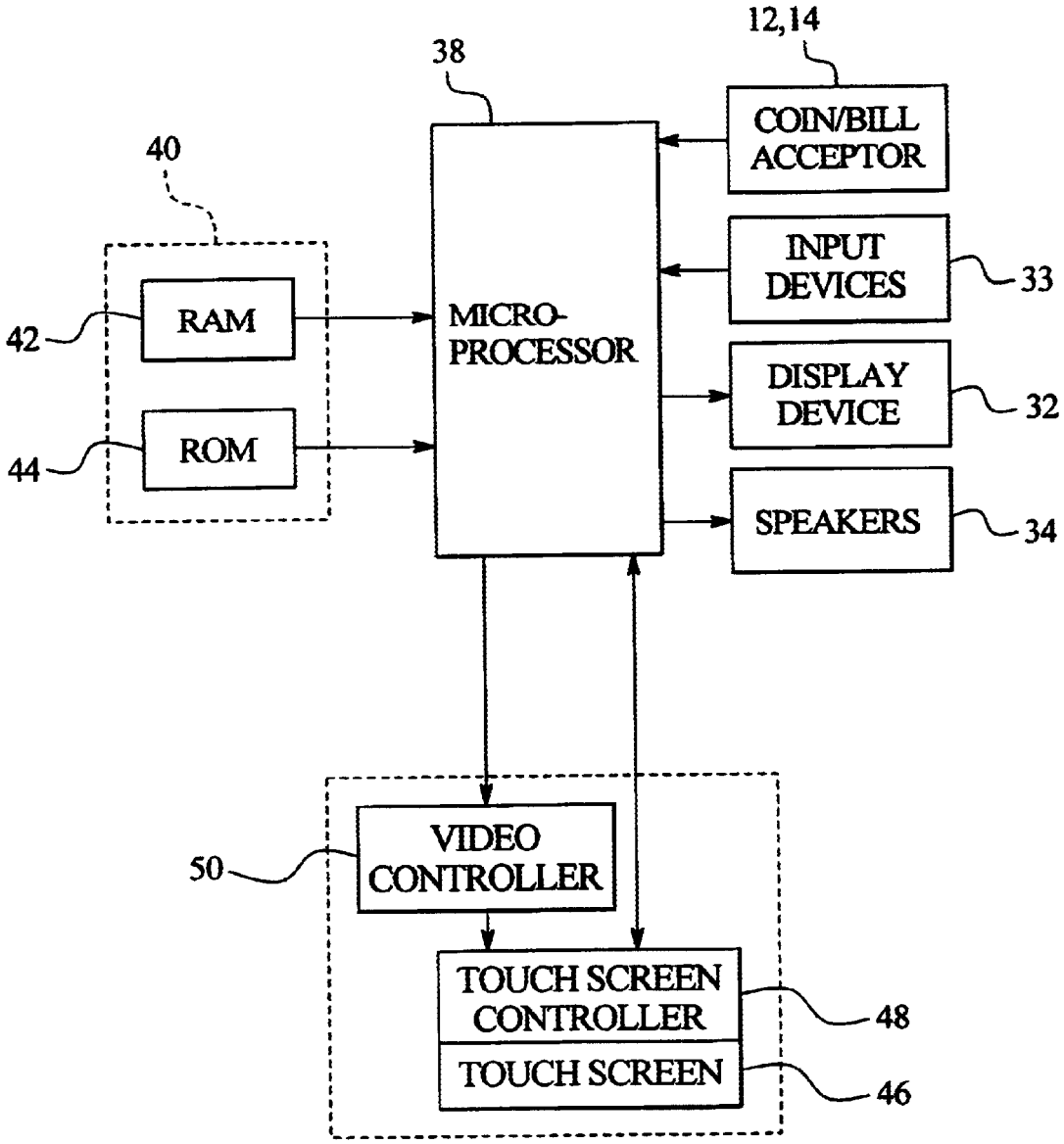
FIG. 2 is a schematic block diagram of the electronic configuration of one embodiment of the gaming device of the present invention.

As illustrated in FIG. 2, the player preferably uses the input devices 33, such as the arm 18, play button 20, the bet one button 24 and the cash out button 26 to input signals into gaming device 10. In certain instances, a touch screen 46 and an associated touch screen controller 48 can be used in conjunction with a video monitor described in detail below. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

Referring to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

Replicating Display

Referring still to FIG. 1, the present invention of the gaming device 10 is embodied in video monitor 32. For the purposes of this invention, the video monitor 32 will hereafter be referred to as the replicating device or display. It should be appreciated that the word replicating encompasses mirroring, shadowing and following as well as replicating.

The replicating display can be any known video monitor, television screen, dot matrix display, CRT, LED, LCD or electro-luminescent display. The replicating display 32 can be color or monochrome although, preferably, the display is color. The replicating display 32 is preferably separate from the paystop display 28 containing the reels 30, even if the paystop display 28 and the reels 30 are in video or simulated form. However, it should be appreciated that the present invention contemplates a single display having the contents of both the paystop display 28 and the replicating display 32.

Figure 3A:
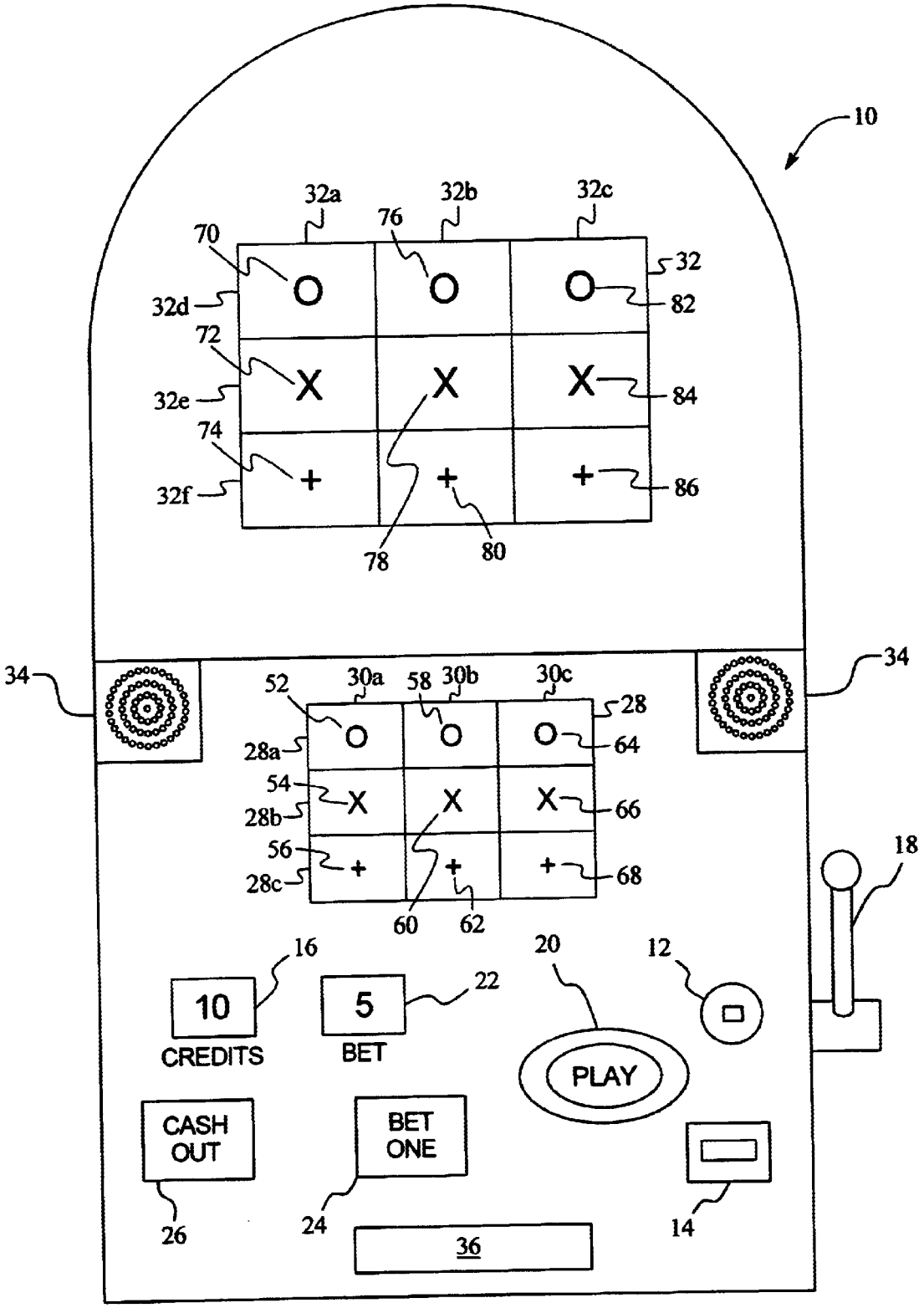
FIG. 3A is a front plan view of one embodiment of the gaming device of the present invention having a second display replicating the random generation of symbols from a first display.

Referring to FIG. 3A, one embodiment of the gaming device of the present invention has a paystop display 28 and a replicating display 32 as described above. The paystop display 28 contains three reels 30*a*, 30*b*, and 30*c*. As described above, the reels 30 can be mechanical or simulated, however, the present invention preferably provides mechanical reels 30. The present invention can have any number of reels and is not limited to the three shown in the embodiment of FIG. 3A. The paystop display 28 also contains the three paylines 28*a*, 28*b* and 28*c*. The present invention can have any number of paylines, but preferably, the present invention contains three paylines as shown.

The paystop display 28 thus displays nine paystops as they would appear after a player has spun the reels, i.e., played the gaming device. Three of the plurality of paystops of reel 30*a* wound up or stopped in paystop display 28, namely, the paystops 52, 54 and 56. Three of the plurality of paystops of reel 30*b* wound up or stopped in paystop display 28, namely, the paystops 58, 60 and 62. Likewise, three of the plurality of paystops of reel 30*c* wound up or stopped in paystop display 28, namely, the paystops 64, 66 and 68.

Based on the paystop display, the replicating display 32 contains three reels. The reels of the replicating display are preferably simulated and contained in a video monitor. In certain instances, the video monitor can contain a touch screen 46 that is connected to a touch screen controller 48 (FIG. 2). The replicating display 32 preferably contains the same number of reels as does the paystop display 28. Therefore, the replicating display 32 contains the three reels 32*a*, 32*b* and 32*c*. The replicating display also preferably contains the same number of paylines as does the paystop display 28 and therefore contains the three paylines 32*d*, 32*e* and 32*f*.

The replicating display 32 therefore preferably contains the same number of paystops as does the paystop display 28. The replicating display has nine paystops, again, as they would appear after a player has spun the reels, i.e., played the gaming device. Three of the plurality of paystops of simulated reel 32*a* wound up or stopped in the replicating display 32, namely, the paystops 70, 72 and 74. Three of the plurality of paystops of reel 32*b* wound up or stopped in the replicating display, namely, the paystops 76, 78 and 80. Likewise, three of the plurality of paystops of reel 32*c* wound up or stopped in the replicating display, namely, the paystops 82, 84 and 86.

The indicia or symbols contained on the paystops of both displays are the same. That is, the indicia or symbols of paystops 52, 54, 56, 58, 60, 62, 64, and 66 are the same as the indicia or symbols of paystops 70, 72, 74, 76, 78, 80, 82, 84 and 86, respectively. For example, both the paystops 52 and 70 display the "0" indicia, both the paystops 78 and 60 display the "X" indicia and both the paystops 86 and 68 display the "+" indicia. It should be appreciated that all the indicia or symbols of the entire reels 30*a*, 30*b* and 30*c*, and those not shown in the paystop display 28, are the same as all the indicia or symbols of the entire reels 32*a*, 32*b* and 32*c* of the replicating display 32, respectively. Although shown only figuratively in FIG. 3A, the paystops of the replicating display 32 are significantly larger and preferably 25% larger than the paystops of the paystop display 28.

In one embodiment of the present invention, the invention contemplates the reels and associated paystops of the replicating display 32 constantly replicating, mirroring, shadowing, or otherwise displaying the same indicia or symbols as the respective reels and associated paystops of the paystop display 28. The mirroring or shadowing occurs whether or not the paystops of the displays are in motion. It is well known for the gaming device of the present invention and it adds much to the excitement and enjoyment, by way of anticipation, for the gaming device to show, the reels spin and the symbols or indicia of the reels blur and become indiscernible to the human eye before stopping to decide the player's fate. With mechanical reels, the indicia show the overshoot and resonance of the reels as they abruptly come to a full stop. The present invention contemplates the simulated reels of the replicating display 32 mirroring or shadowing the resonance effects.

The present invention also contemplates the replicating display 32 mirroring or shadowing different reels of the paystop display 28 stopping at different times. It is well known in the art for the reels of a slot machine to stop at different times. In most instances, the stopping of reels occurs from left to right. That is, the reel furthest to the left stops first, then the reel to the right of the first, etc. until each reel stops. The present invention preferably stops reels of the replication display 32 in the exact same order that the paystop display 28 employs.

The present method contemplates different methods of mirroring the paystop display 28, one of which is through the use of more than one processor. The preferred method is through two processors, one master and one slave, which communicate through a protocol, which is well known in the art. In this method, the master processor 38 tells or commands the slave processor to display certain images in each location on the replicating display 32.

Figure 3B:
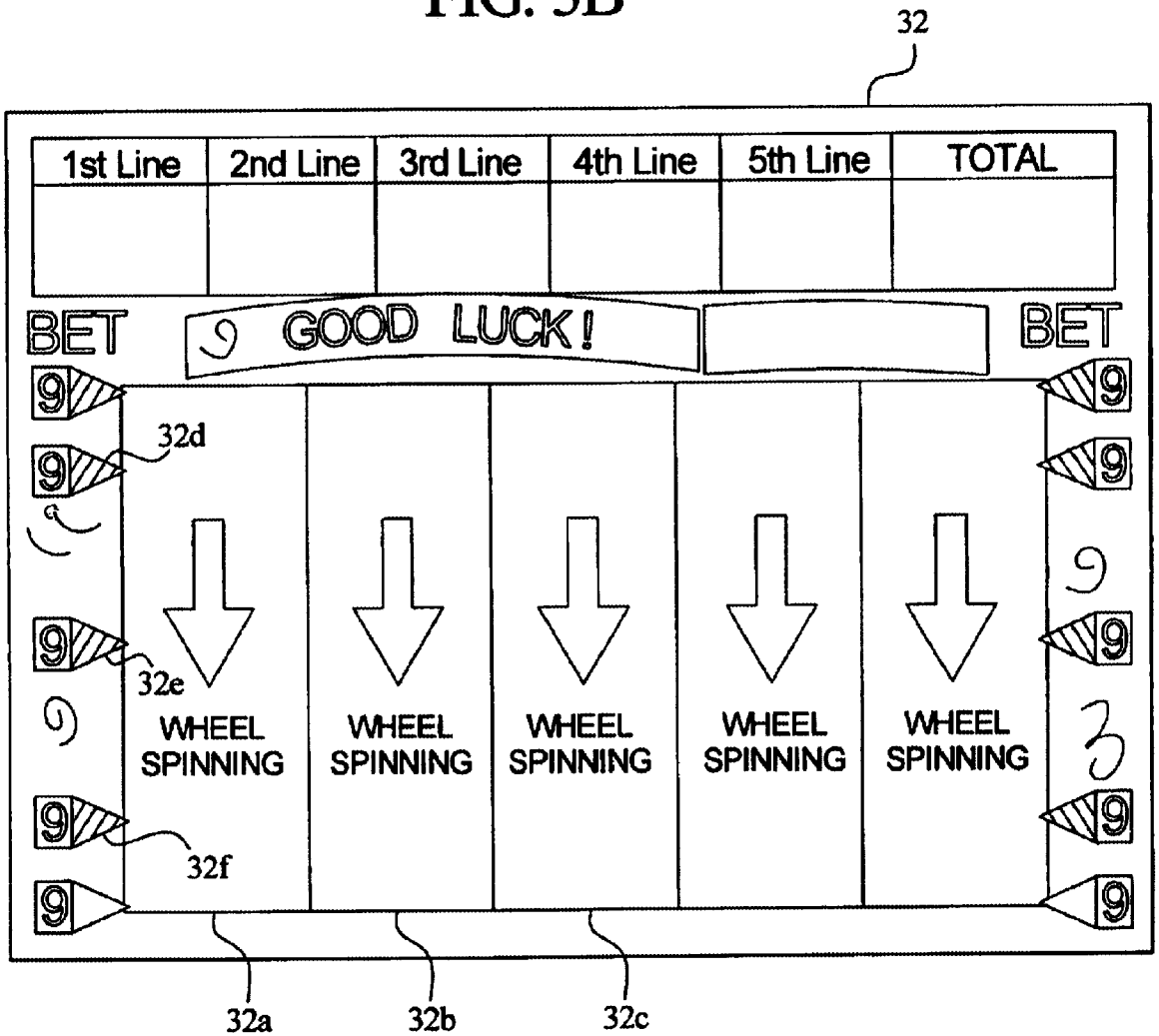
FIG. 3B is a front plan view of another embodiment of the gaming device of the present invention having a second replicating display that merely represents said generation of symbols of said first display.

Referring now to FIG. 3B, an alternative embodiment of the replicating display is shown wherein the symbols of the replicating display 32 represent the spinning of the reels 30 of the display device 28. That is, instead of producing an exact replication of said spinning reels as discussed FIG. 3A, the embodiment of FIG. 3B represents motion by blurring or warping the simulated reels 32*a*, 32*b* and 32*c* of the replicating display 32. When the actual reels 30*a*, 30*b* and 30*c* of the display device 28 come to a stop individually or simultaneously, the corresponding reels of the replicating display 32*a*, 32*b* and 32*c*, likewise stop blurring or warping or otherwise representing motion. The representation in the replicating display 32 of the present invention preferably uses the same colors in the same proportion as do the symbols of the reels 30 of the display device 28. For instance, if the reels of the display device contain a large proportion of yellow lemons and orange oranges, the replicating display contains the same proportion of yellow and orange in the blurred or warped representation of the spinning reels.

Figure 4:
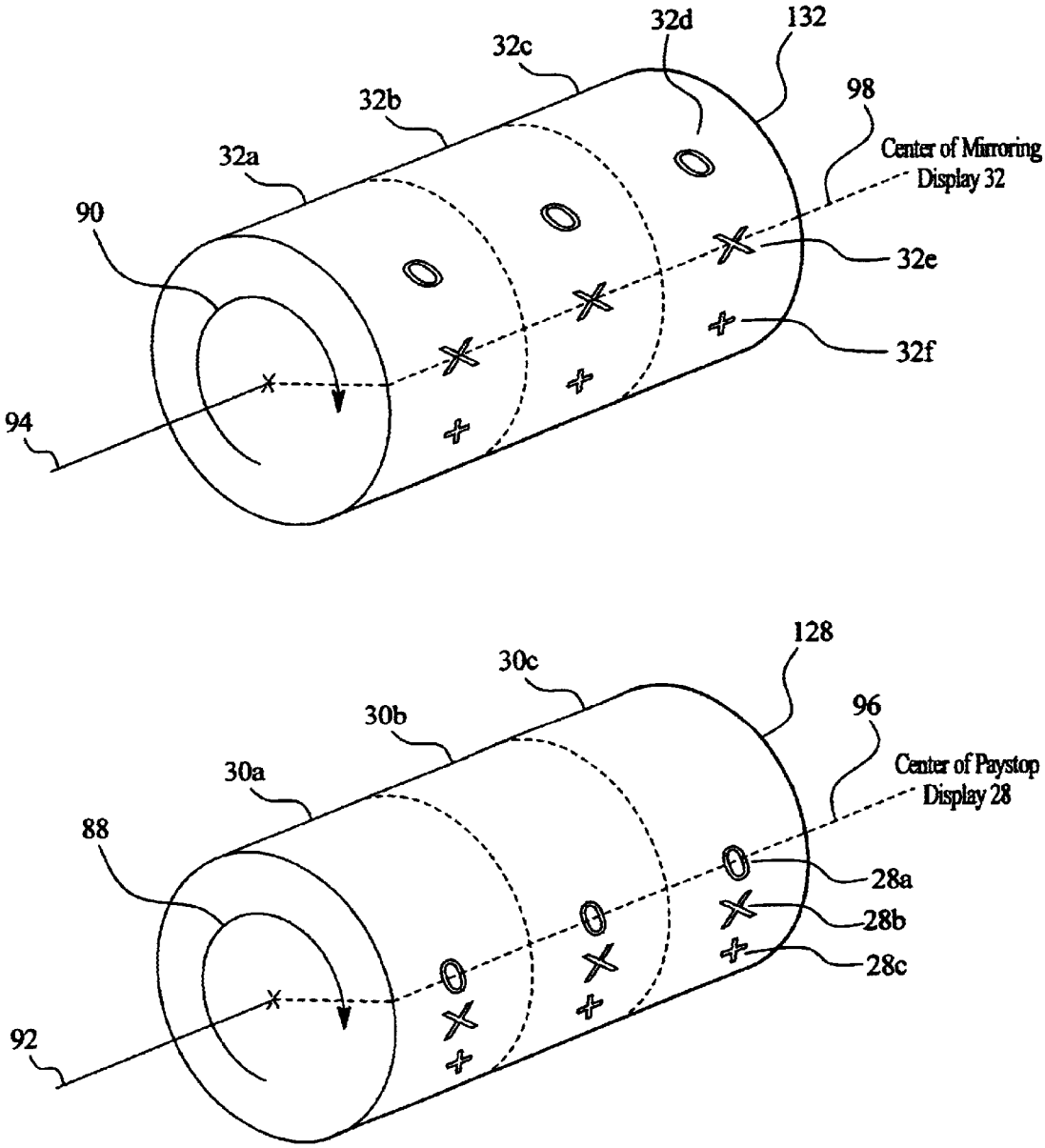
FIG. 4 is a perspective view of a representation of two reels of the present invention that have indicia, which illustrate the delay aspect of the present invention.

Referring to FIG. 4, the present invention contemplates another embodiment in which the replicating display 32 follows or is slightly behind the paystop display 28. That is, there exists a predetermined delay between the display of a particular image on the paystop display 28 and that same image on the replicating display 32, wherein the same image occurs at a later time on the replicating display. FIG. 4 illustrates two rotating drums 128 and 132 that contain the same indicia as do the displays 28 and 32 in FIG. 3A, respectively, although, for the ease of illustration, only the corresponding reel symbols are provided, not the identifying reel symbol numbers.

The rotating paystop drum 128 contains the reels 30*a*, 30*b* and 30*c* as shown in FIG. 3A as well as the paylines 28*a*, 28*b* and 28*c*. Likewise, the rotating replicating drum 132 contains the reels 32*a*, 32*b* and 32*c* as shown in FIG. 3A as well as the paylines 32*d*, 32*e* and 32*f*. The rotating drums 128 and 132 have arrows 88 and 90, respectively, that show a clockwise rotational direction about the drum centerlines 92 and 94.

It should be appreciated that in FIG. 3A, the "X", "X", "X" symbols of the paystop display 28 appear in the center of the display. The identical "X", "X", "X" symbols of the replicating display 32 also appear in the middle of the device. However, the embodiment of FIG. 4 illustrates that the "X", "X", "X" symbols of the drum 128 have already rotated past the paystop centerline 96 while the "X", "X", "X" symbols of the drum 132 are currently rotating past the replicating centerline 98. This illustration demonstrates the delay in the embodiment of the present invention. That is, the paystop drum 128 currently illustrates the "0", "0", "0" symbols rotating past the paystop centerline 96, while the corresponding "0", "0", "0" symbols of the replicating drum 132 will not rotate past the replicating centerline 98 for a predetermined period of time.

The delay embodiment of FIG. 4 contemplates any time delay. The visual effect of the delay is appealing to the player and heightens player excitement and enjoyment. The present invention preferably provides a time delay in the range of 0.2 seconds to 1.0 second. It should be appreciated that except for the delay, the replicating display otherwise replicates the paystop display 28 as illustrated in FIGS. 3A and 3B. That is, the displays contain the same number of reels and paylines, the reels contain the same number of paystops and the paystops display or represent the same symbols or indicia in the same order.

Figure 5:
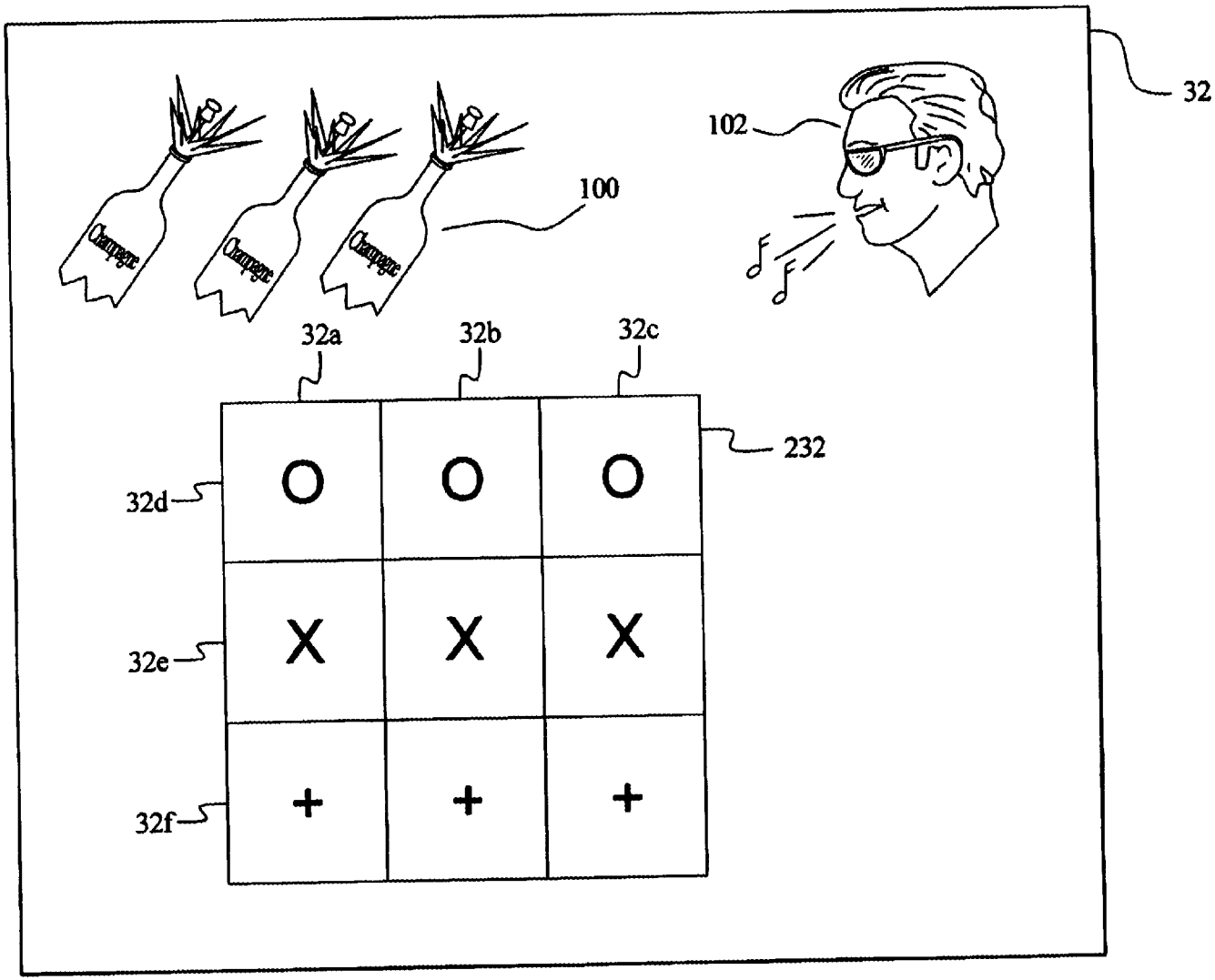
FIG. 5 is an enlarged front plan view of one embodiment of the replicating display of the present invention having additional indicia.

Referring to FIG. 5, the replicating display 32 can have additional indicia or substitute indicia besides a display of the reels of the gaming device. The additional or substitute indicia preferably relate to a theme of the gaming device and add excitement and enjoyment to its operation. The indicia are preferably in addition to the replicating display. For example, FIG. 5 illustrates the replicating display 32 containing a display 232 of the reels 32*a* through 32*c* and the paylines 32*d* through 32*f*, as described above, as well as additional indicia such as the popping champagne bottles 100 and the singing celebrity 102. The champagne bottles and celebrity are preferably part of a theme of the gaming device, which can highlight, signal or embellish a gaming device event such as a large award or payout.

While the reels of the gaming device 10 are inactive, e.g., no player is currently operating the device or the player is taking a brief respite, the replicating display 32 can shut down or discontinue the display 232 of the reels until a player resumes action (not shown). It should be appreciated that in such periods of inactivity, the gaming device is better served by having the entire replicating display presenting indicia relating to the theme of the gaming device.

Alternatively, the replicating display can display static and dynamic sequences, wherein the indicia of the sequences have no relation to the theme of the gaming device. It should be appreciated in periods of inactivity, the gaming device preferably displays indicia that attracts players. Such indicia can relate to a game theme. The indicia can also relate to any theme or event that attracts players. The present invention therefore contemplates displaying additional attractive indicia unrelated to the game theme.

Paylines in Series

Referring to FIGS. 6A through 6J, one embodiment of the present invention contemplates providing a display of any payline that the player has bet or played, and which has obtained or received an award generating or winning combination of symbols after the random generation of the reels (hereafter referred to as a "winning" payline). Paylines are well known visible or invisible lines superimposed upon the paystop display of a gaming device, which the game uses to analyze a player's spin of the reels. FIGS. 6A through 6J all contain a replicating display 32 of the present invention having five reels, 32*g* to 32*k*, and three paylines, 32I to 32*n*. Known gaming devices having such a configuration can and do have up to twenty-five different paylines, however nine is preferred.

Figure 6A:
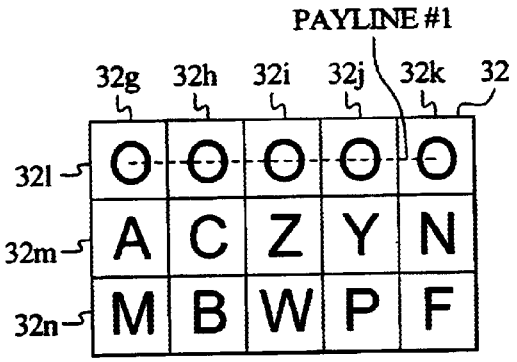
FIG. 6A is a representation of a display of the reels of the present invention, which illustrates one payline of the present invention.
Figure 6B:
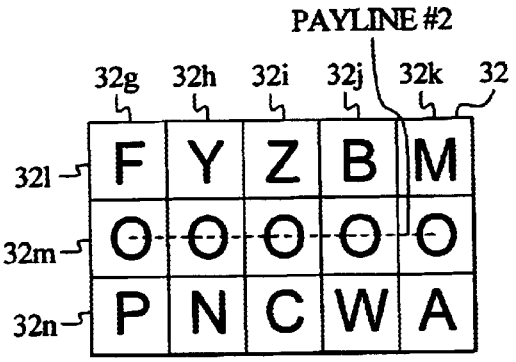
FIG. 6B is a representation of a display of the reels of the present invention, which illustrates another payline of the present invention.
Figure 6C:
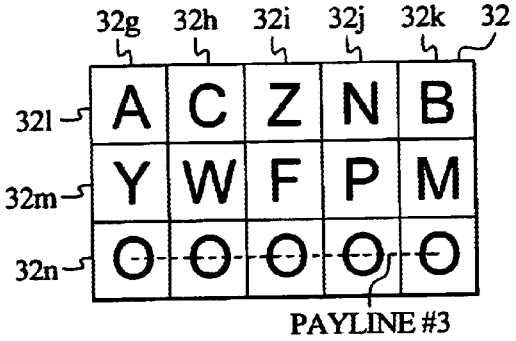
FIG. 6C is a representation of a display of the reels of the present invention, which illustrates a further payline of the present invention.
Figure 6D:
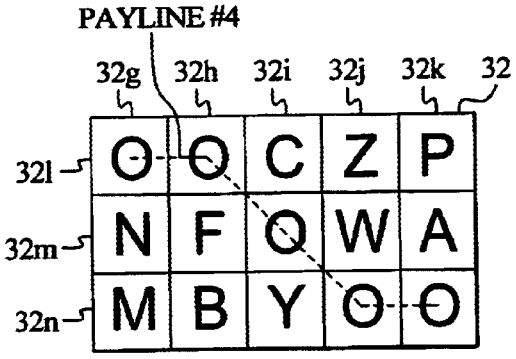
FIG. 6D is a representation of a display of the reels of the present invention, which illustrates still another payline of the present invention.
Figure 6E:
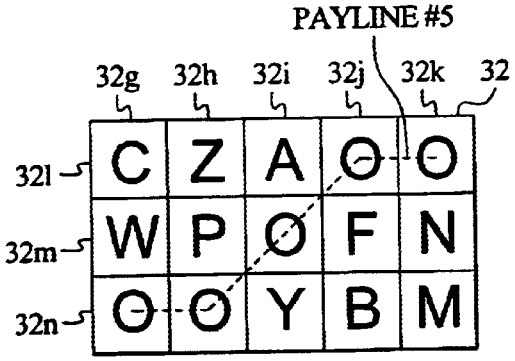
FIG. 6E is a representation of a display of the reels of the present invention, which illustrates a still further payline of the present invention.
Figure 6F:
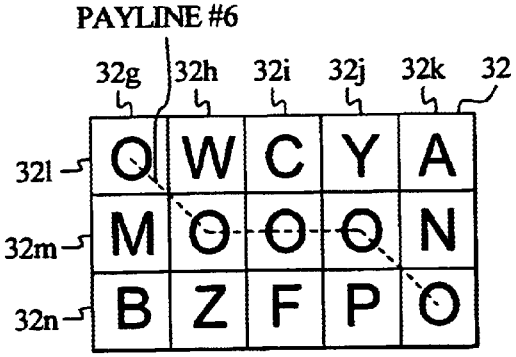
FIG. 6F is a representation of a display of the reels of the present invention, which illustrates yet another payline of the present invention.
Figure 6G:
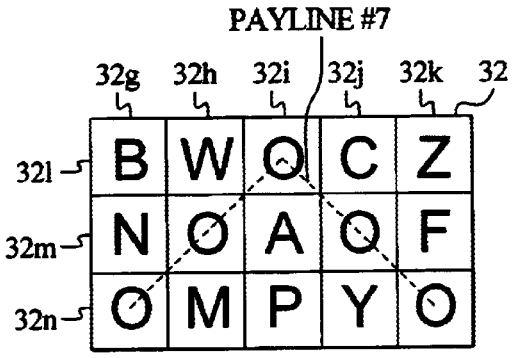
FIG. 6G is a representation of a display of the reels of the present invention, which illustrates yet a further payline of the present invention.
Figure 6H:
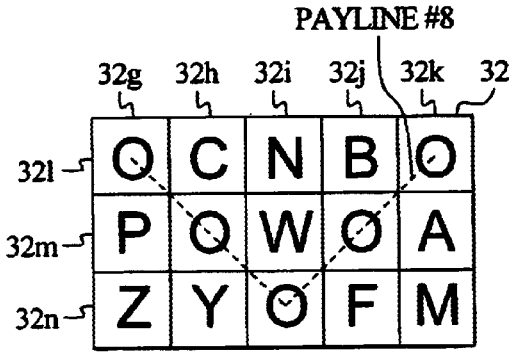
FIG. 6H is a representation of a display of the reels of the present invention, which illustrates again another payline of the present invention.
Figure 6I:
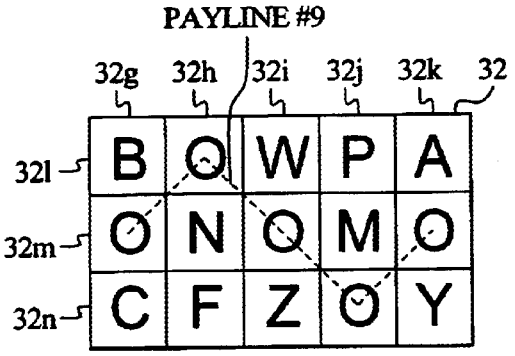
FIG. 6I is a representation of a display of the reels of the present invention, which illustrates again a further payline of the present invention.
Figure 6J:
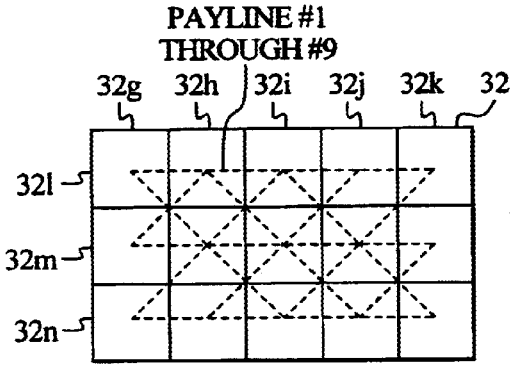
FIG. 6J is a representation of a display of the reels of the present invention, which illustrates the accumulation of paylines of 6A through 6I, in a single display.

FIGS. 6A, 6B and 6C illustrate the paylines #1, #2 and #3, respectively, wherein the "O", "O", "O", "O" and "O" combination comprises a winning combination amongst other random symbols. FIGS. 6D, 6E and 6F illustrate diagonal paylines #4, #5 and #6, respectively, wherein the five "O"'s comprise a winning combination amongst other random symbols. FIGS. 6G and 6H illustrate triangular paylines #7 and #8, respectively with the winning "O" symbols. FIG. 6I illustrates a serpentine payline #9 having the winning "O" symbols. As can be readily seen from these figures, each payline has five adjacent paystops. It should be appreciated that the present invention can include other sets of five adjacent paystops and is not limited to the ones shown in FIGS. 6A through 6I. FIG. 6J illustrates the integration or accumulation of each of the illustrated paylines.

A player playing all nine paylines of a gaming device having only a paystop display such as the display 28 must analyze each of the nine paylines to determine which ones have yielded an award. Players are generally curious as to how they have won or succeeded at a gaming device and also desire to assure themselves that the gaming device has provided an award when it is due and has done so in the correct amount. The present invention provides a method by which the player can easily discern the award generating paylines.

After the display 32 of the present invention mirrors the rotation of the reels of the paystop display 28, the present invention preferably displays each winning payline alone, separately and in series before displaying an accumulation of each of the winning paylines at once. As illustrated by FIGS. 6A through 6I, the replicating display 32 contains both a line and the symbols on or below the line. It is well known in the art to superimpose a line over the reels, preferably on a glass or clear plastic cover protecting the reels, so that the player can discern the paylines when making bets. The replicating display can also contain a piece of glass or clear plastic having the superimposed paylines. The replicating display can itself create and maintain the paylines before, during and after the display of the spinning reels.

In the present method, the player bets or plays any number of paylines, spins the reels and receives an award. The present invention then displays a first winning payline for a predetermined period of time and ends the display, displays a second winning payline for a predetermined period of time and ends the display and displays each winning payline in this manner before finally displaying all the winning displays at once.

Figure 6K:
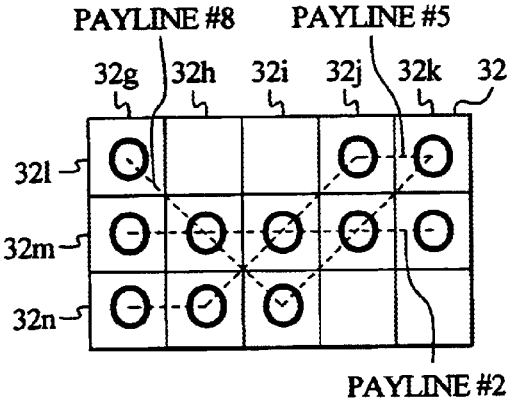
FIG. 6K is a representation of a final display of the payline method of the present invention, wherein three winning paylines are collectively displayed.

Referring to FIGS. 1 and 6A through 6J, the player, for example, bets or plays each payline #1 through #9 in FIGS. 6A though 6I, respectively. The player then spins the reels 30 by pulling the arm 18 or pressing the button 20. The reels generate symbols in all fifteen paystops of the displays in FIG. 6, while the present invention mirrors the generation. The player wins on three paylines, namely, payline #2 of FIG. 6B, payline #5 of FIG. 6E and payline #8 of FIG. 6H. The replicating display 32 of the present invention displays only the payline #2 of FIG. 6B for three seconds, then the payline #5 (FIG. 6E) for three seconds, then the payline #8 (FIG. 6H) for three seconds and finally the display of FIG. 6K showing all three paylines, i.e., winning combinations, at once for a predetermined period of time.

The payline method of the present invention preferably stops the display of one winning payline before beginning the display of another, so that each display is separate and easily discernable. Each winning payline can be displayed for any suitable amount of time, preferably from one to two seconds, and each may be displayed for a different period of time. The present invention does not require that the paylines be presented in any order, however, the present invention preferably displays the paylines in the order that the gaming device presents the paylines to the player. That is, the game displays the paylines in the order in which the player chooses to play or not to play a particular payline.

The payline method alternatively contemplates an overlap of the payline displays, or further, the accumulation of winning paylines as opposed to the serial fashion of the preferred embodiment. The present invention may present a first winning payline, add a second winning payline while still displaying the first, add a third and so on until all the winning paylines are presented at once as is done at the end of the preferred embodiment in FIG. 6K.

The method of the present invention preferably works in conjunction with the replicating function of the replicating display 32. That is, the replicating display 32 preferably mirrors the spinning reels and outcome of the paystop display 28 and then produces the winning paylines in the serial fashion described above. It should be appreciated that the payline display must contain the same number of reels, paylines, paystops and order of indicia as the paystop display 28 to properly present the winning paylines, which are sections or components of the paystop display. The method also includes providing displays having indicia related or unrelated to the theme (described above), which attracts players when the game is idle and while the game is presenting an award to a player. This additional or substitute indicia therefore does not include a display of the paylines or of award winning symbols of said paylines.

Figure 6L:
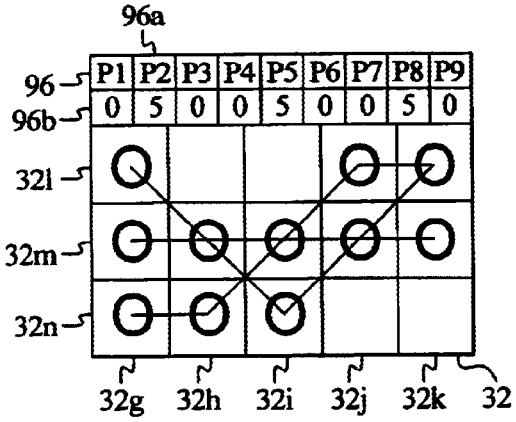
FIG. 6L is a representation of a final display of the payline method of the present invention illustrating an alternative embodiment wherein the display contains the payout for each winning payline.

Referring to FIG. 6L, an alternative embodiment of the payline method of the present invention is illustrated, wherein the replicating display 32 contains a table or organization of the payouts for each payline. FIG. 6L contains the same winning paylines as illustrated in FIG. 6K, namely, paylines #2, #5 and #8 for FIGS. 6A through 6J. FIG. 6L also contains a table or organization 96 having a representative 96*a* of each payline and a number 96*b*, wherein the number represents the award for the payline from the most recent spin of the reels. The representation of each payline 96*a* preferably contains identifying indicia, such as the "P1" and "P2" shown in FIG. 6L or "1st LINE" and "2nd LINE" as desired by the implementor. The number 96*b* is preferably placed close to the identifying indicia so that the player can easily connect the payline and the amount.

Figure 7:
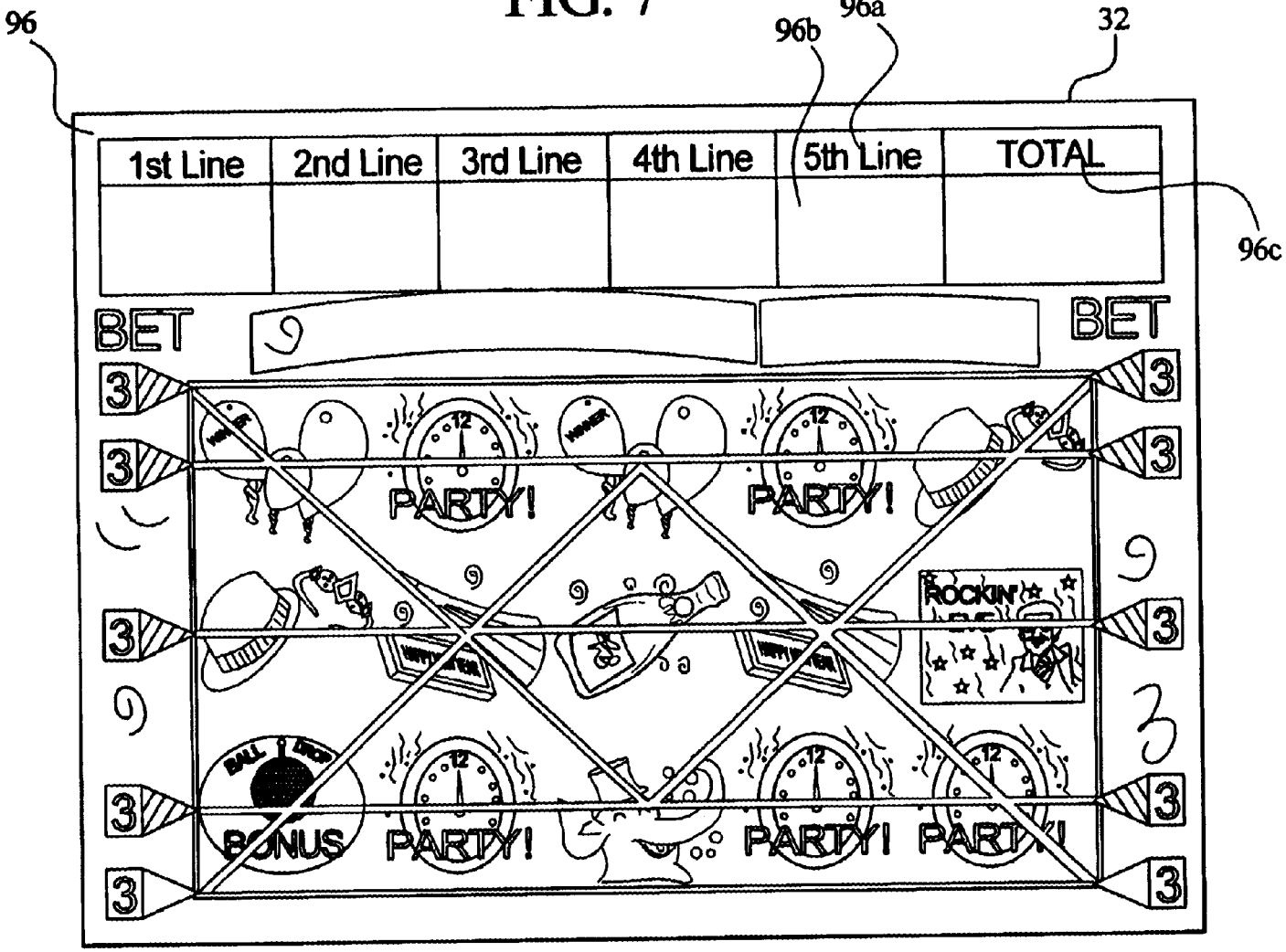
FIG. 7 is an enlarged front plan view of one embodiment of the replicating display of the present invention having a payout table that includes a display of the total payout.

Referring to FIG. 7, a replicating display 32 of the present invention is shown containing the pay chart, table or organization 96 of payouts from each payline having a representative 96*a* of each payline, a payout number display 96*b* and, additionally, a total payout display 96*c* at the end of table 96. It should be appreciated that the organization or table 96 containing the total payout display 96*c* can be horizontally configured, as shown, vertically configured, or configured in any manner in relation to the replicating display 32 as desired by the implementor. The implementor can place the organization on table 96 having a total payout display 96*c* along the top edge (as shown), bottom edge, left edge or right edge of the replicating display 32 as desired.

The table 96 can display the payout numbers 96*b* as the replicating display 32 sequences through each payline or do so only at the end when the game displays the accumulation of winning paylines. The game can accumulate the payout number displays 96*b* as they are sequentially displayed or display them separately and sequentially before the accumulated display. The display can place zeros in the payout number displays 96*b* that the player does not bet or place another suitable symbol or no symbol in the payout number displays 96*b* for each inactive, unplayed payline.

Figure 8:
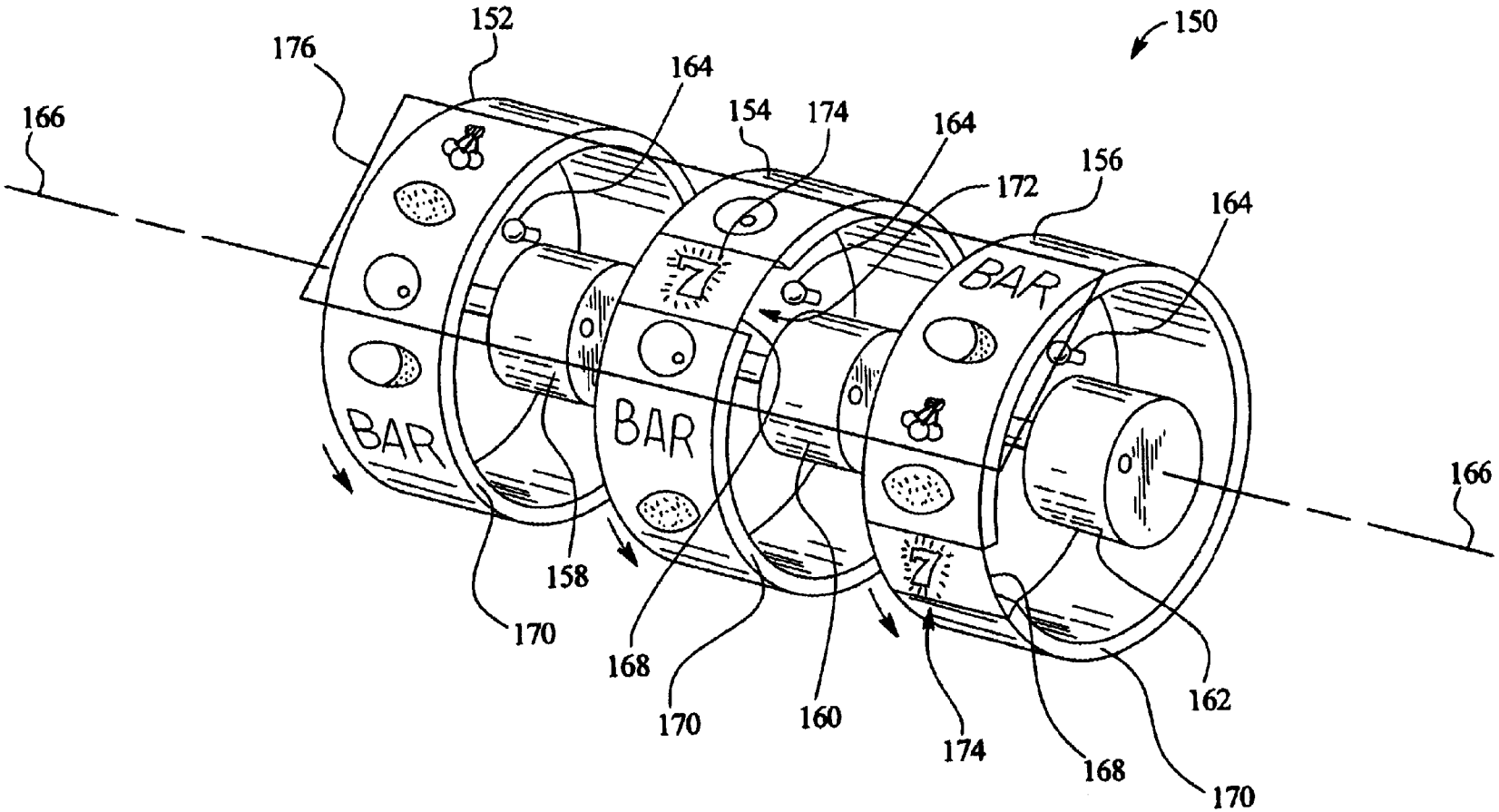
FIG. 8 is a perspective view of a plurality of reels of the gaming device having means on the inside of said reels to selectively illuminate said symbols.
Figure 9:
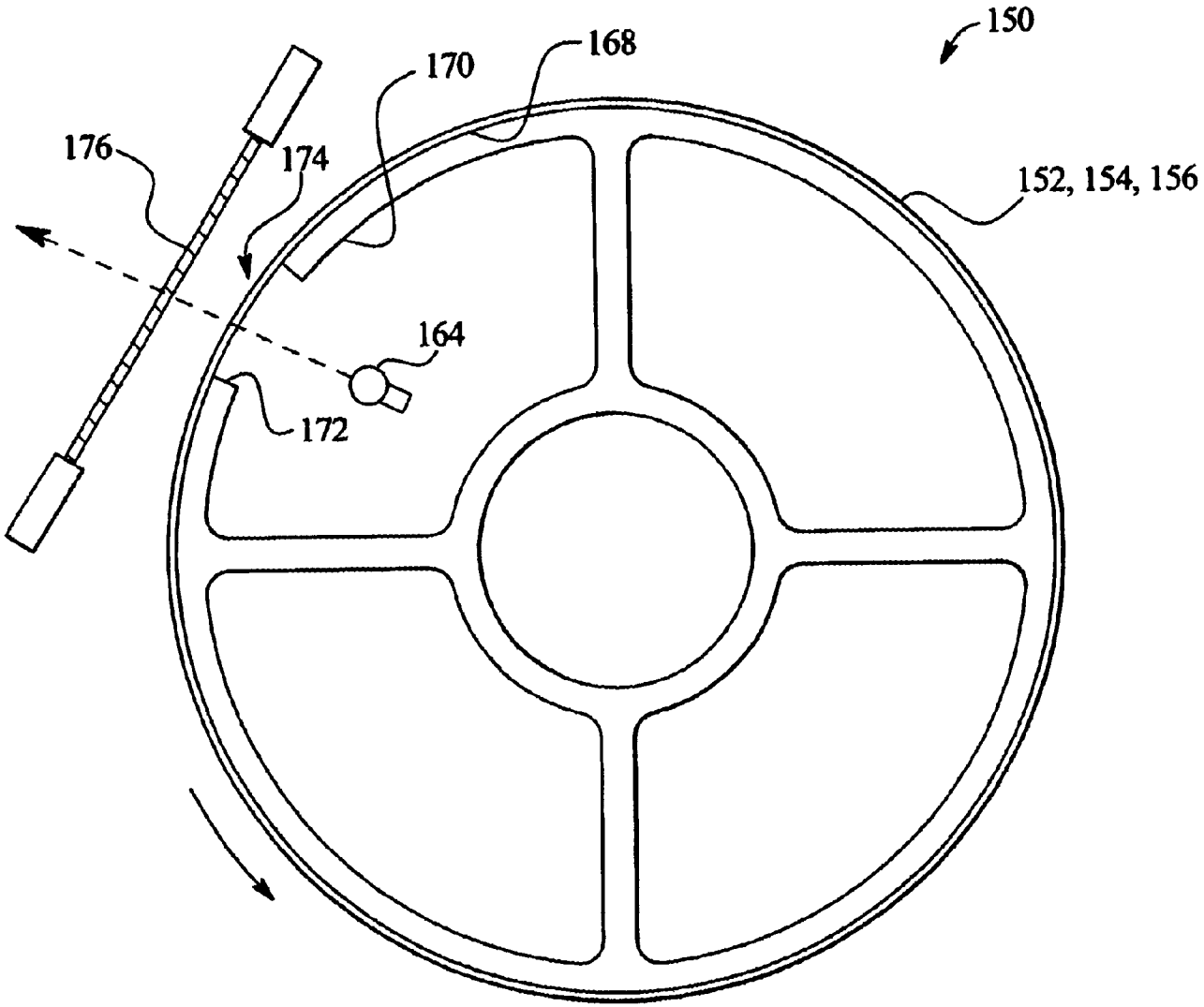
FIG. 9 is a side view of a plurality of reels of the gaming device having means on the inside of said reels to selectively illuminate said symbols.

Referring now to FIGS. 8 and 9, an alternative embodiment of the present invention is illustrated, wherein the reels 30 of the gaming device contain lights between the axis of rotation of the reels and the symbols of the reels. The lights enable the implementor of the gaming device to selectively illuminate one or more of the reels. Lighting symbols, commonly referred to in the art as backlighting, is well known. The gaming device can backlight certain symbols such as award generating symbols. Alternatively, the gaming device can backlight a plurality of symbols. The present invention preferably backlights all the symbols as the reels spin, while the replicating display 32 replicates the generation of symbols.

When the present invention stops spinning the reels 30 of the display device 28 and displays the winning paylines on the replicating display 32, the present invention preferably turns off the backlights, except for backlights lighting a winning payline, to highlight the payline display. This is, after the reels having stopped spinning, the present invention preferably leaves a winning payline lit but turns off all other backlights. The present invention can alternatively turn off all the backlights to highlight the payline display.

Referring to FIG. 8, a perspective view of one example of a backlighting system 150 is shown having the reels 152, 154 and 156. The reels are driven and positioned by individual stepper motors 158, 160 and 162. Each reel has an associated light 164 disposed between a centerline 166 of said reels and the outer reel tape 168, which contains the symbols. In this embodiment, the outer reel tape 168 adheres to and circumscribes a masking member 170. The masking members 170 contain openings 172 that enable the backlights 164 to illuminate special symbols 174. The lights 164 are positioned so that illuminated special symbols 174 can be viewed from a window 176 that covers the display device 28.

Referring to FIG. 9, a side view of one example of a backlighting system 150 is shown having a reel such as the reels 152, 154 or 156. FIG. 9 illustrates the positioning of the light 164 in relation to an opening 172 in a reel masking member 170 which supports the reel tape 168 having special symbols 174. The light 164 illuminates the special symbol 174 so that a person playing the gaming device can see the illumination through the viewing window 176. This example illustrates how the gaming device can selectively illuminate one or more symbols. It should be appreciated that by providing many openings 172, the gaming device can illuminate many or all of the symbols. The gaming device can also turn the light 164 on and off to selectively illuminate or darken the display device 28.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is hereby claimed as follows:

1. A gaming device comprising:

a cabinet;

means supported by the cabinet for displaying a plurality of symbols and a plurality of paylines;

a replicating device supported by the cabinet and operable to independently display said symbols and the plurality of paylines; and a controller operable with the display means and the replicating device to cause the replicating device to independently mirror the symbols and movement of the symbols displayed by the display means, and upon said displayed symbols on at least two paylines yielding an award to a player, to cause the replicating device to sequentially and separately display each of the award yielding paylines and symbols thereon.

2. The gaming device of claim 1, wherein the display means includes at least one mechanical reel and the replicating device is adapted to display at least a portion of a simulation of said mechanical reel.

3. The gaming device of claim 2, wherein said at least a portion of a simulation includes a representation of said mechanical reel.

4. The gaming device of claim 1, wherein the display means includes at least one simulated reel and the replicating device is adapted to display at least a portion of said simulated reel.

5. The gaming device of claim 1, wherein the display means includes at least one payline superimposed on said symbols, and the replicating device is adapted to display said payline.

6. The gaming device of claim 1, wherein the replicating device includes a monitor.

7. The gaming device of claim 1, wherein said symbols of said replicating display are larger than said symbols of said display means.

8. The gaming device of claim 1, wherein said replicating display includes at least one visual display of items other than said symbols.

9. The gaming device of claim 8, which includes an audio production relating to said at least one visual display of items other than said symbols.

10. The gaming device of claim 1, which includes means, disposed between the axis of rotation of said means for displaying a plurality of symbols and said plurality of symbols, for selectively illuminating at least one symbol of at least one reel.

11. A gaming device comprising:

a cabinet;

a first display supported by said cabinet and operable to display a plurality of symbols;

a plurality of paylines associated with the first display; and a second display supported by said cabinet and operable to independently display each of said paylines and a plurality of the symbols along each of said paylines, whereby said second display sequentially and separately displays at least two of the paylines and the symbols along said paylines which yield an award for a player.

12. The gaming device of claim 11, wherein said second display includes a pay chart adapted to display the award associated with each of said paylines.

13. The gaming device of claim 11, wherein said second display includes at least one visual display of items other than said symbols.

14. The gaming device of claim 11, which includes means, disposed between the axis of rotation of said first display and said plurality of symbols, for selectively illuminating at least one symbol of at least one reel.

15. A method for displaying a gaming device outcome comprising the steps of:

(a) displaying a first display in a cabinet having a plurality of game generated symbols;

(b) independently replicating said first display of the plurality of game symbols on a second display in said cabinet; and (c) sequentially and separately displaying on the second display at least two paylines and the game symbols on said paylines which yield an award to a player.

16. The method of claim 15, wherein the first display includes a plurality of reels and replicating said first display includes replicating each reel of said first display.

17. The method of claim 15, which includes simultaneously replicating said first display.

18. The method of claim 15, which includes replicating said game symbols at a slower rate than a rate of said first display.

19. The method of claim 15, which includes representing said symbols of said replicating display.

20. The method of claim 15, which includes delaying said replicating display so that a combination of the game symbols appears on said first display before said combination appears on said replicating display.

21. The method of claim 15, which includes producing at least one display in addition to said replication, wherein said additional display does not include said game symbols.

22. The method of claim 15, wherein displaying a first display having a plurality of game generated symbols includes selectively illuminating said symbols.

23. A method for operating a gaming device comprising:

(a) displaying a plurality of movable symbols in a first display supported by a cabinet, wherein the first display includes at least one mechanical device; and (b) independently replicating the first display of said plurality of movable symbols, including any movement of said plurality of movable symbols, in a second display supported by said cabinet, and then displaying at least one of said movable symbols in the second display to indicate an award associated with said movable symbol.

24. The method of claim 23, which includes displaying a plurality of paylines and at least one of said movable symbols along each payline in a second display to indicate an award associated with each payline.

25. The method of claim 24, which includes sequentially displaying said paylines in said second display.

26. The method of claim 24, which includes simultaneously displaying said paylines in said second display.

27. The method of claim 24, which includes sequentially displaying said paylines in said second display and then simultaneously displaying said paylines in said second display.

28. The method of claim 24, which includes displaying a pay chart of award values associated with each payline displayed in said second display.

29. The method of claim 23, which includes producing at least one display in the second display in addition to replicating said plurality of movable symbols, wherein said display does not include said payline having at least one movable symbol.

30. The method of claim 23, wherein displaying said plurality of movable symbols in the first display includes selectively illuminating said movable symbols.

31. A gaming device comprising:

a cabinet;

a plurality of symbols;

a first display device supported by the cabinet, said first display device including at least one mechanical device associated with the plurality of symbols;

a second display device supported by the cabinet, and operable to independently display the plurality of symbols; and a processor operable with the first and second display devices to cause the second display device to independently mirror a display of the plurality of symbols and any movement of said symbols by the first display device.

32. The gaming device of claim 31, wherein the mechanical device includes a plurality of gaming reels.

33. The gaming device of claim 31, which includes at least one award associated with the plurality of symbols.

34. The gaming device of claim 31, which includes a plurality of awards associated with the plurality of symbols.

35. The gaming device of claim 31, wherein the processor causes said second display device to display a plurality of paylines and the symbols along said paylines which yield a plurality of awards for the player.

36. The gaming device of claim 35, which includes a pay chart for displaying the award associated with each of said paylines, wherein the processor causes the second display device to display said pay chart.

37. The gaming device of claim 31, wherein the second display mirrors the display of the plurality of symbols and any movement of the symbols of the first display device at a slower rate than a rate of the first display device.

38. The gaming device of claim 31, wherein said processor causes said second display device to display images other than said symbols.

39. The gaming device of claim 38, which includes an audio production relating to said images other than said symbols.

40. The gaming device of claim 31, wherein said symbols displayed by said second display are larger than said symbols displayed by the first display.

41. A gaming device comprising:

a game operable upon a wager by a player;

a cabinet;

a plurality of symbols in the game;

a plurality of random generating devices of the game supported by the cabinet, said random generating devices each operable to randomly generate at least one of said symbols; and a replicating display supported by said cabinet, and operable to independently display a duplicate of the symbols, including any movement of said symbols, generated on each of the random generating devices.

42. The gaming device of claim 41, wherein the plurality of random generating devices includes a plurality of mechanical gaming reels.

43. The gaming device of claim 41, wherein the plurality of symbols is associated with at least one award.

44. The gaming device of claim 43, wherein the replicating display is operable to display the award and any of symbols associated with said award.

45. The gaming device of claim 41, wherein the replicating display includes at least one visual display of items other than said symbols.

46. A method for displaying a gaming device outcome, said method comprising:

(a) displaying a plurality of generated symbols in a first display supported by a cabinet;

(b) independently replicating said display of the generated symbols on a second display supported by said cabinet; and (c) upon the occurrence of two winning symbol combination on two paylines in the first display, sequentially and separately displaying on the second display said paylines and the symbols on said paylines which yield an award to a player.

47. The method of claim 46, which includes replicating said generated symbols on the second display at a slower rate than a rate of said first display.

48. The method of claim 46, which includes delaying said replicating of said generated symbols so that a combination of the generated symbols appears on said first display before said combination appears on said second display.

49. The method of claim 46, which includes producing at least one display in addition to said replication, wherein said additional display does not include said generated symbols.

50. A gaming device comprising:

a cabinet;

a game operable upon a wager by a player;

a mechanical display device supported by a first portion of the cabinet;

a video display device supported by a second portion of the cabinet; and a processor supported by the cabinet and operable to control the game, said processor operable upon a triggering event to cause the mechanical display device to provide a display to a player and to cause the video display device to independently replicate the display to the player of the mechanical display device, including any movement displayed by the mechanical display device.

51. The gaming device of claim 50, wherein the mechanical display device includes a plurality of gaming reels.

52. The gaming device of claim 50, wherein the triggering event is the wager made by the player.

53. A method for operating a gaming device comprising:

(a) displaying a plurality of symbols in a first display supported by a cabinet, wherein the first display includes at least one mechanical device, said display is part of a game operable upon a wager by a player and said mechanical device moves said symbols; and (b) independently replicating the first display of said plurality of symbols including the movement of the symbols by the mechanical device in a second display supported by said cabinet, and then displaying sequentially a plurality of paylines and any of said symbols along said paylines in the second display to indicate any winning outcome associated with each payline.

54. The method of claim 53, wherein said mechanical device includes at least one reel.

55. The method of claim 53, wherein the gaming device is controlled through a data network.

56. The method of claim 55, wherein the data network is an internet.

57. The method of claim 53, wherein computer instructions for controlling steps (a) and (b) are stored on a memory device.

58. A method for operating a gaming device comprising:

(a) displaying a plurality of symbols in a first display supported by a cabinet, wherein the first display includes at least one mechanical device; and (b) independently replicating the first display of said plurality of symbols in a secondary display supported by said cabinet, and the displaying sequentially and then simultaneously a plurality of paylines and at least one of said symbols along each of said paylines in a second display to indicate any award associated with each payline.

59. The method of claim 58, wherein said mechanical device includes at least one reel.

60. The method of claim 58, wherein the gaming device is controlled through a data network.

61. The method of claim 60, wherein the data network is an internet.

62. The method of claim 58, wherein computer instructions for controlling steps (a) and (b) are stored on a memory device.

* * * * *

UNITED STATES PATENT AND TRADEMARK OFFICE

CERTIFICATE OF CORRECTION

PATENT NO. : 6,695,696 B1
DATED : February 24, 2004
INVENTOR(S) : Kaminkow

It is certified that error appears in the above-identified patent and that said Letters Patent is hereby corrected as shown below:

Column 2,
Line 67, change “tract” to -- track --.

Column 6,
Line 19, change “pushing” to -- or pushing --.

Column 11,
Line 1, change “32I” to -- 32l --.

Column 12,
Line 58, change “organization or” to -- organization of --.

Signed and Sealed this

Fifteenth Day of June, 2004

JON W. DUDAS
*Acting Director of the United States Patent and Trademark Office*